US006698747B2

(12) United States Patent
Dobbertin et al.

(10) Patent No.: US 6,698,747 B2
(45) Date of Patent: Mar. 2, 2004

(54) METHOD AND SYSTEM FOR PROVIDING SHEET STACK LEVEL CONTROL

(75) Inventors: Michael T. Dobbertin, Honeoye, NY (US); Thomas K. Sciurba, Webster, NY (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 131 days.

(21) Appl. No.: 09/777,947

(22) Filed: Feb. 6, 2001

(65) Prior Publication Data

US 2002/0140159 A1 Oct. 3, 2002

(51) Int. Cl.[7] ..... B65H 1/08

(52) U.S. Cl. ..... 271/30.1; 271/147; 271/152; 271/157

(58) Field of Search ..... 271/30.1, 31, 147, 271/152, 157

(56) References Cited

U.S. PATENT DOCUMENTS

| | | | | |
|---|---|---|---|---|
| 4,835,573 A | | 5/1989 | Rohrer et al. | 355/308 |
| 5,342,037 A | * | 8/1994 | Martin | 271/147 X |
| 5,344,133 A | | 9/1994 | Jantsch et al. | 271/94 |
| 5,634,634 A | | 6/1997 | Dobbertin et al. | 271/3.02 |
| 5,794,928 A | * | 8/1998 | Araseki et al. | 271/157 X |
| 5,823,527 A | | 10/1998 | Burlew et al. | 271/265.02 |
| 5,876,030 A | | 3/1999 | Dobbertin et al. | 271/13 |
| 5,988,629 A | | 11/1999 | Burlew et al. | 271/152 |
| 6,286,827 B1 | * | 9/2001 | Meetze, Jr. et al. | 271/147 X |

* cited by examiner

*Primary Examiner*—David H. Bollinger

(57) ABSTRACT

A system and method for providing the ability to more effectively control a paper stack in a reproduction apparatus. The level control behavior of the paper stack is characterized, and accordingly, additional lift commands are signaled when the behavior indicates that such increments are necessary. The behavior is characterized by sampling data during a sampling period including switch initiated increments. Upon characterization, additional increments are initiated by a source other than the switch initiated increments to more effectively control the paper stack.

20 Claims, 7 Drawing Sheets

METHOD AND SYSTEM FOR PROVIDING SHEET STACK LEVEL CONTROL

FIELD OF THE INVENTION

This present invention relates to a system and method for providing paper stack level control in a reproduction apparatus.

BACKGROUND OF THE INVENTION

In typical reproduction devices, such as copiers or printers, for example, information is reproduced on individual cut sheets of receiver material such as plain bond or transparencies. Receiver sheets, of the various types, are stored in stacks and respectively fed seriatim from such stacks when copies are to be reproduced thereon. The sheet feeder for the reproduction devices should be able to handle a wide range of sheet types and sizes reliably and without damage. Desirably, the sheets are accurately fed individually from the sheet stack, that is, without misfeeds or multi-feeds.

Reproduction device sheet feeders are typically of two types, vacuum feeders or friction feeders. However, of the two types, friction feeders are typically the least reliable, because sheet materials exhibit a wide variation in friction characteristics. Nevertheless, an exemplary vacuum sheet feeder is shown in a U.S. Pat. No. 5,344,133, issued Sep. 6, 1994, in the name of Jantsch et al. In such an apparatus, a stack of sheets is stored in a supply hopper. A sheet feed head assembly, including a plenum, a vacuum source in flow communication with the plenum, and a mechanism, such as a feed belt associated with the plenum, urges a sheet acquired by vacuum in a sheet feeding direction away from the sheet supply stack.

Typically, in most vacuum sheet feeders, the sheet supply stack is supported to maintain the topmost sheet at the feed head assembly. A first positive air supply then directs a flow of air at the sheet supply stack to levitate the top several sheets in the supply stack to an elevation enabling the topmost sheet to be acquired by vacuum from the sheet feed head assembly plenum. Additionally, a second positive air supply typically directs a flow of air at an acquired sheet to assure separation of any additional sheets adhering to such topmost sheet.

It is clear that the sheet stack should be maintained in operative relation with the sheet feed head assembly to assure desired feed from the stack. An exemplary control of a sheet stack is shown in a U.S. Pat. No. 5,823,527, issued Oct. 20, 1998, in the name of Burlew et al. In such an apparatus, a sheet feeder is disclosed having a platform for supporting a stack of sheets, a feed head assembly for feeding sheets seriatim from the top of a sheet supply stack on the platform, a mechanism for moving the platform relative to the feed head assembly, and device for controlling operation of the platform moving mechanism. The control device can determine a selected parameter in response to examination of sheet stack parameters, and consequently produce a signal corresponding thereto. The speed of the platform moving mechanism is then set based on the parameter signal.

In a typical vacuum sheet feeder, a portion of the stack is usually first lifted or "fluffed" and then sheets are fed off this fluffed group, singularly. At some point in time, the height of the top of the fluffed group is preferably low enough to allow for a paper level sensor to deactuate, and thus, signal a lift command to the motor. Generally, this occurs prior to feeding the last sheet of that fluffed group. If not, more sheets are lifted off the top of the unfluffed portion of the stack.

However, for certain types of receivers, it has been found for most notably heavyweight paper with poorly cut edges that a portion of the top of the stack is sometimes lifted, such that the level sensors remain actuated, even as the fluffed portion is being fed. Once this fluffed portion is fed, the next sheet will not be pre-separated from the rest of the stack, and consequently, the top of the remaining stack will be a greater distance below the vacuum plenum than is desired. This can lead to an undesirable increase in the probability of feed errors.

The embodiments described herein allow for more effectively controlling the level of a sheet stack.

SUMMARY OF THE INVENTION

Addressing the problems with receiver feeder supplies, the present embodiments provide the ability to more effectively control a receiver stack. The exemplary embodiments disclose a system and method capable of increasing the efficiency of receiver stack level control.

The present invention provides a number of advantages and applications as will be readily apparent to those skilled in the art. Utilizing the disclosed embodiments, the present invention allows increased probability of feeding sheets when the receivers have a tendency to stick together during the pre-separation and fluffing phase. Additionally, the embodiments can provide for better control of the top level of the unfluffed portion of the stack, which may improve the feed performance for some receivers. The exemplary embodiments utilize level control characterization and accordingly inject additional increments, as needed.

The foregoing and other objects, features and advantages of the present embodiments will be apparent from the following more particular description of exemplary embodiments of the system and the method as illustrated in the accompanying drawings.

DETAILED DESCRIPTION OF PREFERRED EMBODIMENTS

The present embodiments described herein, provide the ability to more effectively control a paper stack in a reproduction device. The system and method have been implemented in a reproduction device utilizing a top feed vacuum feeder. However, it should be understood that the present embodiments can be implemented in a reproduction device that utilizes other types of feeders, including variations of the vacuum feeder or a friction feeder. Thus, the exemplary embodiments disclose a system and method that can be utilized to increase the efficiency for any type of reproduction machine.

Figure 1:
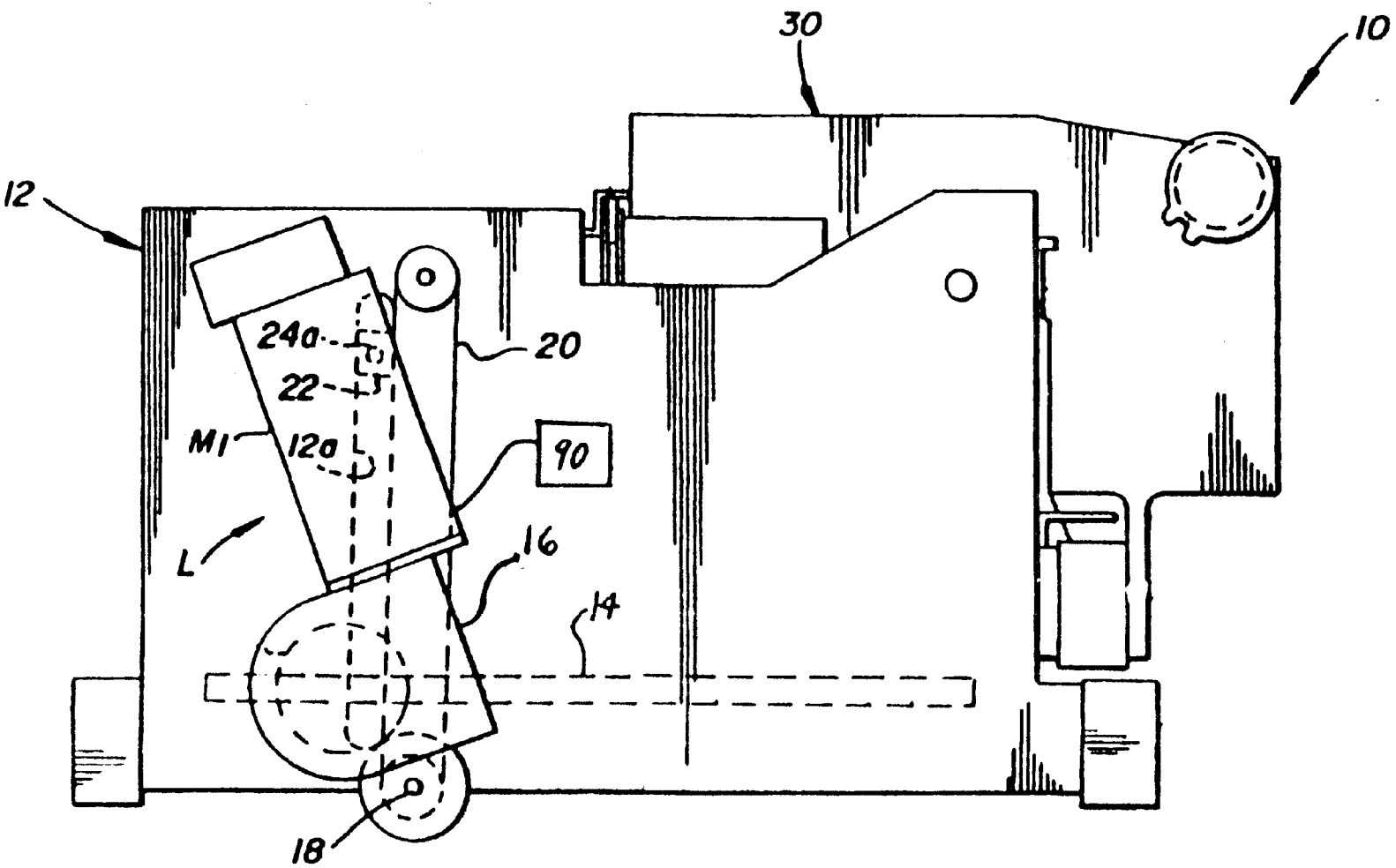
FIG. 1 is a side elevational view of an exemplary receiver sheet supply and feeding apparatus.

FIG. 1 is a side elevational view of an exemplary receiver sheet supply and feeding apparatus that utilizes the present embodiments. The receiver sheet supply and feeding apparatus 10 generally includes an open hopper 12 and an elevating platform 14 for supporting a stack of sheets. The sheet stack (not shown) supported on the platform 14 contains individual sheets suitable, for example, for serving as receiver sheets for having reproductions formed thereon in a copier or printer device. Sheets for receiving reproductions may be selected from a wide variety of materials and sizes. For example, the sheets may be of a weight in the range of 49 grams per square meter ("gsm") to 300 gsm index, and a size in the range of 8×10 inches to 14×18 inches.

The sheet stack supporting platform 14 is supported within the hopper 12 for substantially vertical elevational movement by a lifting mechanism ("L"). Preferably, the lifting mechanism L serves to raise the platform 14 to an elevation for maintaining the topmost sheet in the stack at a predetermined level during operation of the receiver sheet supply and feeding apparatus 10, and to lower the platform to permit adding sheets thereto. The lifting mechanism L may include a motor ("$M_1$"), attached to the outside of the upstanding front wall of the hopper 12. Preferably, the motor $M_1$ rotates a gear set 16 mounted on a shaft 18 extending from the upstanding rear wall of the hopper. A pair of sprocket mounted lifting chains 20 are respectively interconnected by gears with the shaft 18 to be moved about a closed loop path when the shaft 18 is rotated by the motor $M_1$. As shown in FIG. 1, the sheet stack supporting platform 14 is shown in its lowest position in phantom.

Figure 2:
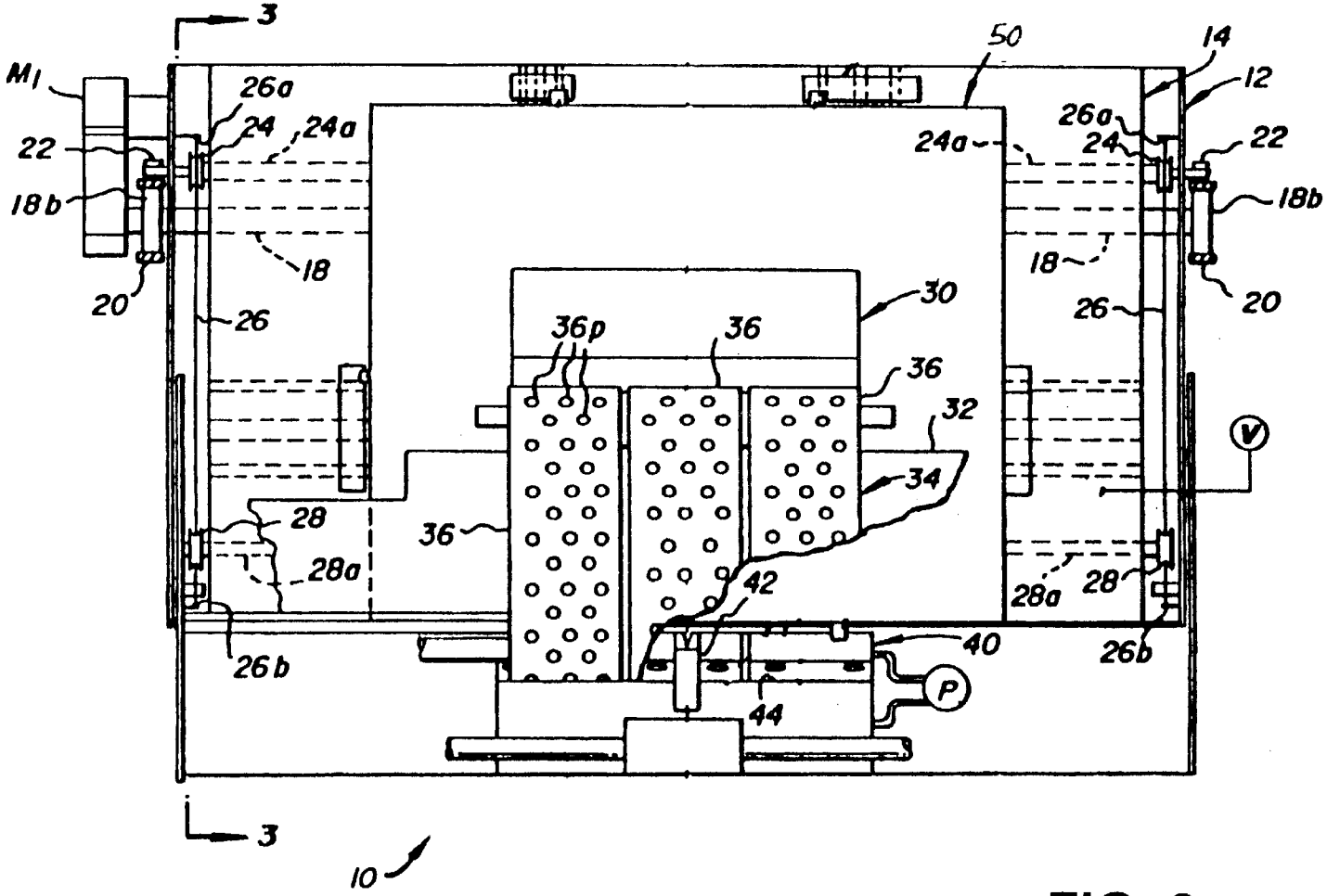
FIG. 2 is a top plan view of the receiver sheet supply and feeding apparatus of FIG. 1, with portions removed or broken away to facilitate viewing.

FIG. 2 is a top plan view of the receiver sheet supply and feeding apparatus of FIG. 1, with portions removed or broken away to facilitate viewing of a sheet feed head assembly 30. The sheet feed head assembly 30 is generally located in association with the hopper 12, so as to extend over a portion of the platform 14 in spaced relation to a sheet stack supported thereon. The sheet feed head assembly 30 includes a ported plenum 32 connected to a vacuum source V, and an air jet device 40 connected to a positive pressure air source P. Preferably, the positive pressure air jet from the air jet device 40 levitates the top several sheets in the supported sheet stack 50, while the vacuum at the plenum 32 is effective through its ports to cause the topmost levitated sheet from the stack to thereafter be acquired at the plenum 32 for separation from the sheet stack. Additional positive pressure air jets from the air jet device 40 helps to assure separation of subsequent sheets from the acquired topmost sheet. To further assure separation of sheets from the sheet stack, the lifting mechanism (for example, L in FIG. 1) preferably presents the top sheet a specified distance from the vacuum plenum 32.

Figure 3:
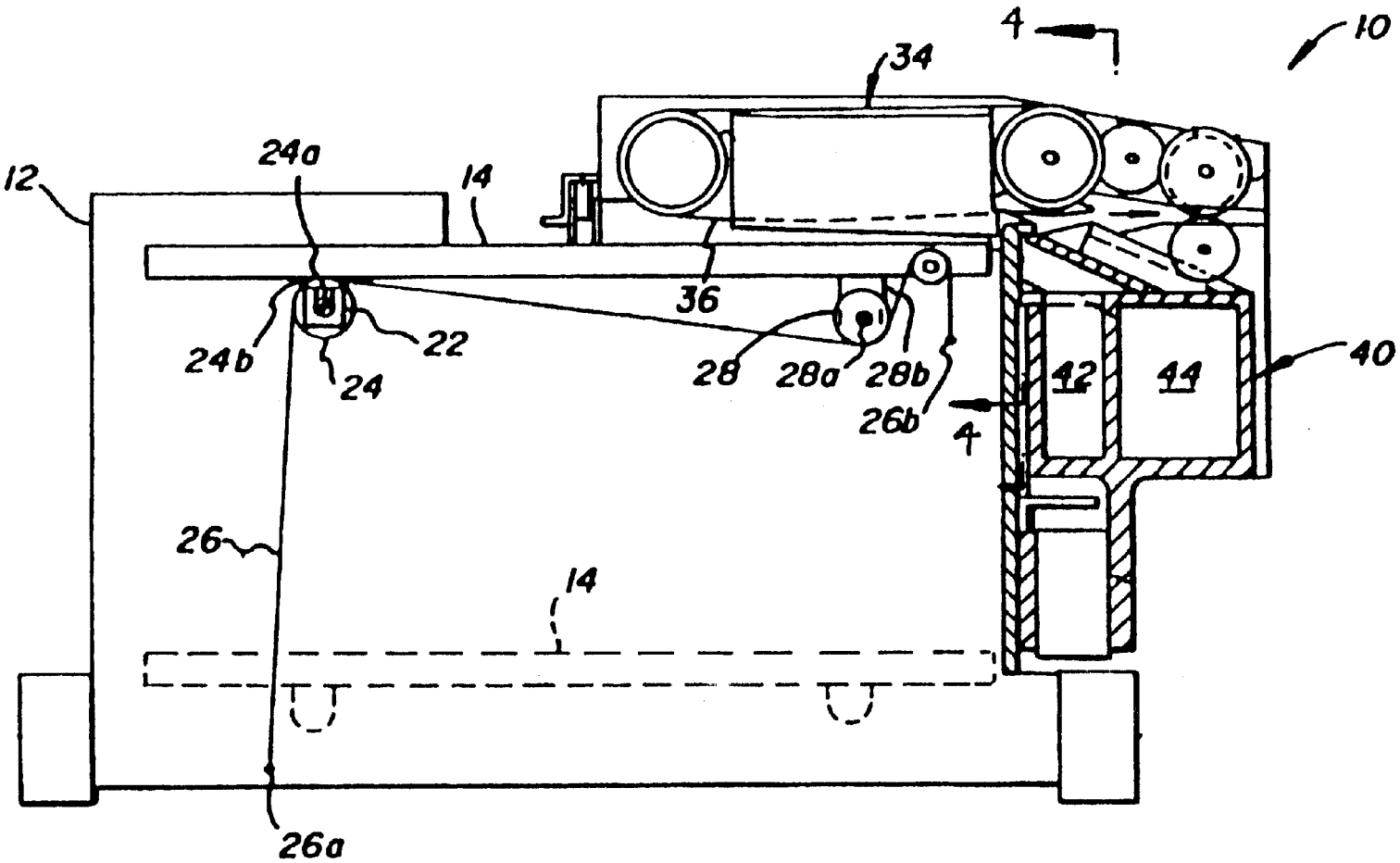
FIG. 3 is a side elevational view of a cross-section of the receiver sheet supply and feeding apparatus taken along lines 3—3 of FIG. 2, particularly showing the platform elevating mechanism.

FIG. 3 is a side elevational view of a cross-section of the exemplary receiver sheet supply and feeding apparatus 10 taken along lines 3—3 of FIG. 2, particularly showing the platform lifting mechanism. Each of the lifting chains have a link 22 extending through respective slots 12*a* (FIG. 1) in the front and rear upstanding walls of the hopper 12. The links 22 are connected to respective first sprockets 24 mounted on a shaft 24*a* supported in brackets 24*b* extending from the underside of the platform 14. Tension cables 26 are respectively connected, at the ends 26*a*, 26*b* thereof, to the front and rear upstanding wall of the hopper 12. The cables are respectively threaded over their associated first sprockets 24 and under second sprockets 28 mounted on a shaft 28*a* supported in the brackets 28*b* extending from the underside of the platform 14.

In FIG. 3, the sheet stack supporting platform 14 is shown in its most elevated position in solid lines, and in its lowest position in phantom. During the operation of the lifting mechanism L, an appropriate signal to the motor $M_1$ causes the motor to rotate the gear set 16 (FIG. 1), such as either clockwise to lower the platform 14 toward the lowest position or counterclockwise to raise the platform toward its most elevated position. Rotation of the gear set 16 moves the lifting chains 20 (FIG. 1) in their closed loop paths, thereby imparting vertical movement to the links 22. This movement, in turn, moves the shaft 24*a*, and thus the platform 14, and as well as its brackets 24*b* and first sprockets 24. The platform 14 is maintained substantially level in its movement by the action of the tension cables 26, which cooperatively move the second sprockets 28, and thus, the shaft 28*a* and the brackets 28*b* of the platform.

Figure 4:
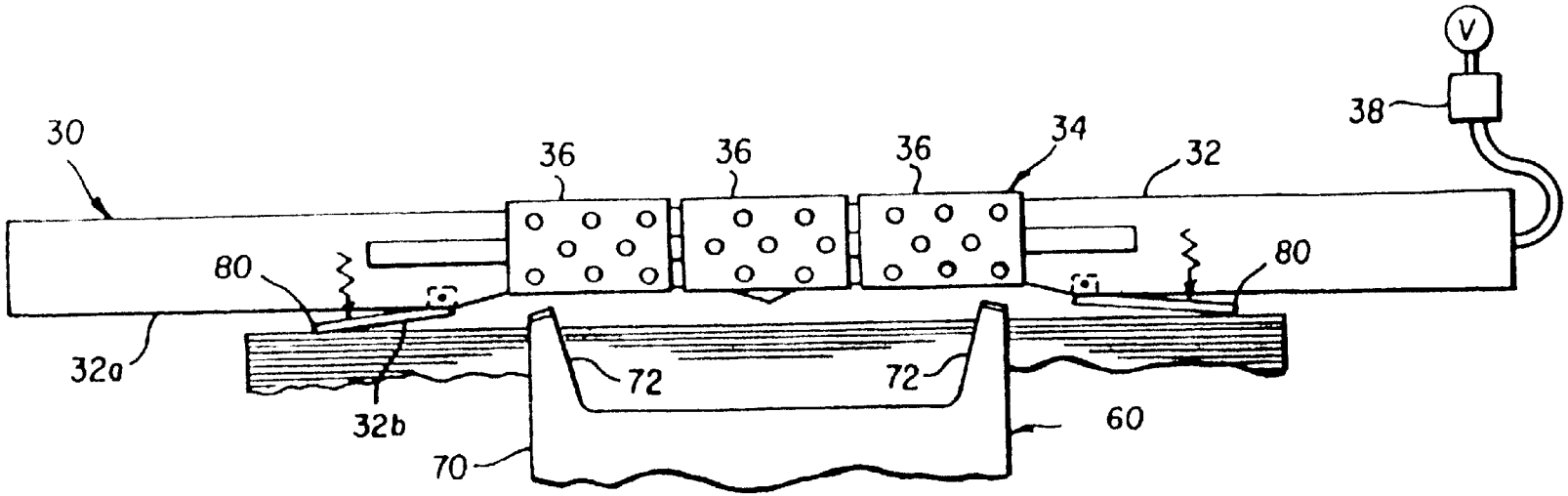
FIG. 4 is an end view, on an enlarged scale and with portions removed, of a portion of the receiver sheet supply and feeding apparatus, particularly showing the feed head assembly thereof, taken along the lines 4—4 of FIG. 3.

FIG. 4 is an end view, on an enlarged scale and with portions removed, of a portion of the receiver sheet supply and feeding apparatus 10, particularly showing the feed head assembly 30 thereof, taken along the lines 4—4 of FIG. 3. Preferably, maintaining the topmost sheet at the predetermined level is accomplished by one or more sheet detecting switches 80, which controls the operation of the motor $M_1$ for actuating the lifting mechanism L, (more described below), to raise the platform 14 through a predetermined increment. On the other hand, lowering of the platform 14 is usually accomplished by some externally produced signal to the motor which tells the motor to rotate until the platform 14 reaches a down switch that signals the motor to stop, often bringing the platform 14 to its lowest position.

Of course, other precisely controllable lifting mechanisms, such as worm gears, lead screws, or scissor linkages are suitable for use in the elevation control for the sheet stack supporting platform 14 according to these embodiments.

Preferably, the lower surface 32*a* of the plenum 32 of the sheet feed head assembly 30 has a particularly configured shape, so as to provide for a specific corrugation of an acquired sheet. As the top sheets in the supported sheet stack are levitated, the topmost sheet preferably contacts the outer winged portions 32*b* of the surface 32*a*. A minimal pressure is exerted on the sheet to help in forming a controlled corrugation to the sheet. This establishes a consistent spacing for the center portion of the sheet from the center portion of the plenum 32. As such, the access time for a sheet to be acquired at the plenum is often repeatably consistent and readily predictable.

The interactions of the plenum 32 and the air jet device 40 attempt to assure that control over the sheet, as it is acquired at the plenum 32, is not lost. Further, corrugation of the sheet contorts the sheet in an unnatural manner. Since subsequent sheets are not subjected to the same forces, at the same time, as is the topmost sheet, such subsequent sheets are unable to contort in the same manner. Accordingly, the subsequent sheets are effectively separated from the topmost sheet as it is being acquired at the plenum 32.

As noted above, it is important for proper operation of the sheet supply and feeding apparatus 10, according to this embodiment, for the level of the topmost sheet in the stack supported on the platform 14 to be maintained at a predetermined height relative to the plenum 32. The level is selected to be in a range where the topmost sheet, when levitated by the first air jet arrangement 42, is close enough to the plenum 32 to be readily acquired by the vacuum forces from the plenum 32, within a repeatable time frame, but yet far enough away from the plenum 32 to assure that the sheet being acquired is not pinned by the plenum 32.

Preferably, each of the switches 80, as noted above, are designed to detect the level of the topmost sheet. Such switches 80, as known in the art, could be for example, a paper guide that rides against the sheet with very little downward pressure, at the highest level of acceptable corrugation, as found in U.S. Pat. No. 5,823,527, in the name of Burlew et al. Additionally, paper level actuators could be integrated into an optical switch so as to cause limited pressure on the sheet. The switches 80 can be read during the feed interval, and if necessary, will transmit a signal to the lifting mechanism L to raise the platform 14 in one or more increments, hereinafter referred to as primary increments. Preferably the primary increments can maintain the proper sheet level. The location of the switches 80 at the highest level of acceptable corrugation is an advantage in that each of the switches 80 can sense the location of sheets which may be severely curled and still not pin the sheet to the plenum 32. It should be understood that other types of switch or switches, as known in the art, may be utilized to generate a primary increment, such as sensors that can detect the weight of the sheet stack, and in response to the detected weight generate a primary increment, etc.

Referring back to FIG. 1, to further assure separation of sheets from the sheet stack, the lifting mechanism L can present the top sheet a desirable distance from the vacuum plenum, in response to a second signal that originates from a secondary source 90 other than the switches 80, such as by a microprocessor executing source code, or hardware logic. However, before the lifting mechanism L initiates a lift due to the second signal, the level control is characterized, preferably at the start of a reproduction process. In an exemplary embodiment, the second signal initiates additional lift commands, referred to hereinafter as a secondary increment, whenever the behavior, based on the characterized level control, indicates that the incremental lifts are necessary.

Figure 5:
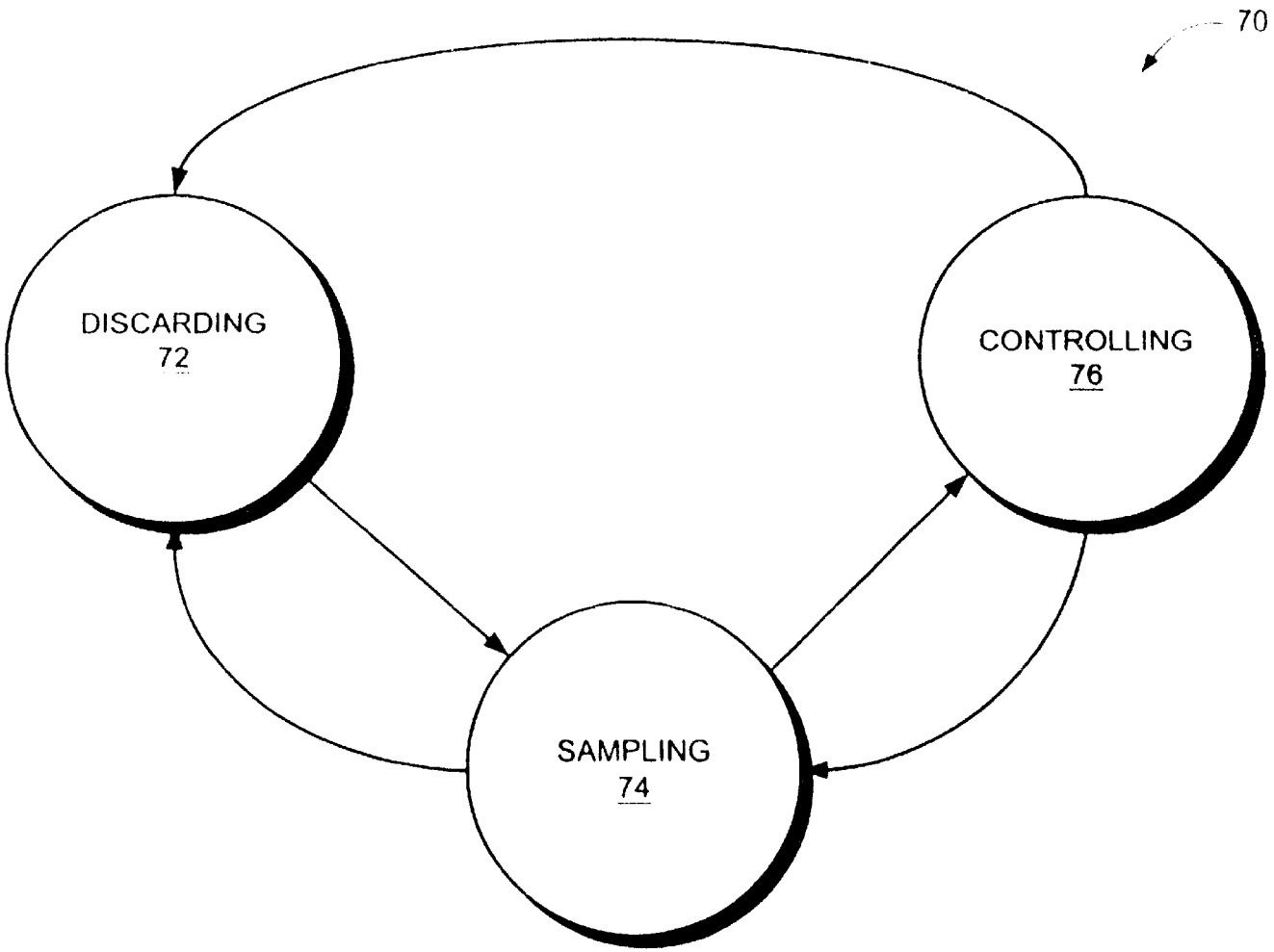
FIG. 5 is a block diagram illustrating an exemplary state machine diagram utilized by the exemplary receiver sheet supply and feeding apparatus of FIG. 1.

FIG. 5 is a block diagram illustrating an exemplary state machine 70 diagram utilized by the exemplary receiver sheet supply and feeding apparatus of FIG. 1. The state machine 70 diagram helps illustrate an exemplary method for generating a second signal to initiate a platform 14 lift, or equivalently for purposes of illustration, a secondary increment. Preferably, the secondary increments are utilized to maintain an appropriate position of the top of the sheet stack, when, for example, one of the switches 80, mistakes the level of the actual top sheet stack. In this diagram, the transitions between the states are indicated by directed lines connecting the states. To perform secondary increments, the level control initiated by either of the switches 80 is preferably characterized in the Sampling state 74, while the Controlling state 76 can preferably implement the appropriate secondary increments as needed.

Preferably, the process of initiating secondary increments can occur at any point in the reproduction process. Therefore, the system can enter into a Discarding state 72, where it initializes, and preferably, resets any related data that has been previously accumulated. In the Discarding state 72, the system may wait until some number of primary increments occur. Consequently, data associated with these primary increments are discarded, upon which, the system can enter the Sampling state 74.

The Sampling state 74 can utilize stored or entered parameters including: the number of primary increments (i.e., switch 80 initiated increments) in a sample period ("$P_S$"), a step size scaling factor indicating a preferred secondary increment increase size ("$P_D$"), a sheet scaling factor indicating a preferred number of sheets before a secondary increment is initiated ("$P_M$"), and a preferred number of secondary increments that can occur in a row ("$P_C$")

Although the parameters can be determined or set to be any desired number, in an exemplary embodiment, $P_S$ is set to three primary increments in one sample period, $P_D$ is set to one-half to indicate that a secondary increment is two times greater in magnitude than a primary increment, $P_M$ is set to two to indicate that two times more sheets are fed than typical before a primary increment is performed, and $P_C$ is set to three to indicate that three secondary increments can occur in a row. It should be understood, however, that the parameters described above can be set or determined to any desired number, and furthermore, can be adjusted to achieve a variety of desired paper level control results.

In an exemplary embodiment, each of the parameters are stored in a memory storage device, such as in random access memory ("RAM") or in read only memory ("ROM"). To enter the parameters, each can be previously set to a fixed number, such as in software or hardware, or the parameters can be dynamically entered through an input, such as a keypad or dial, which may be located on the reproduction apparatus (not shown).

Figure 6:
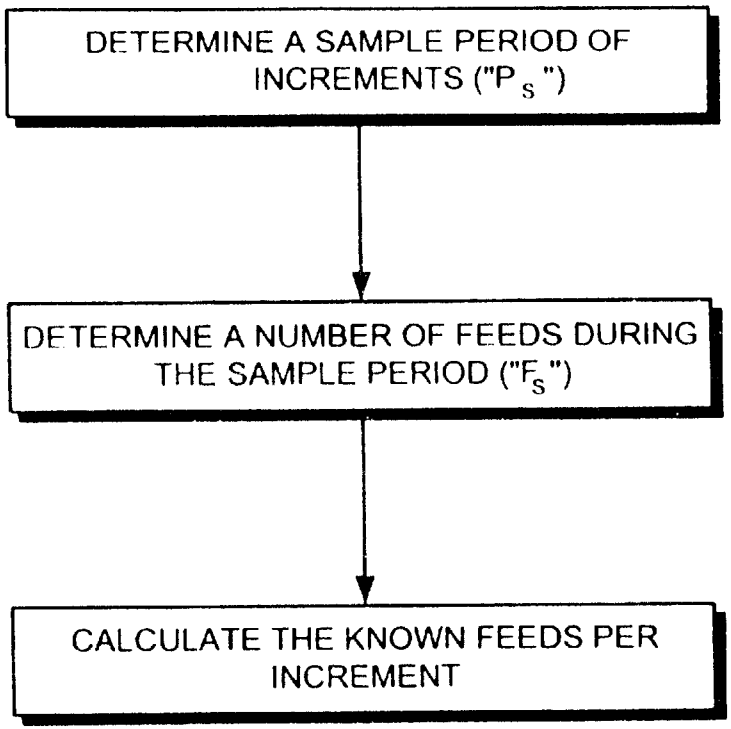
FIG. 6 is a flow diagram illustrating an exemplary method for calculating a feeds per increment in accordance with the present embodiments.

Referring to FIG. 6, the Sampling state 74 duration is preferably specified as a number of primary increments, and is preferably given by the parameter $P_S$. During this Sampling state 74, data is collected that can be used to characterize the level control for a sheet stack. Included in this data collection is the number of sheets fed during the sample period, $F_S$, and the total number of primary increments taken during the sample period, $P_S$. From the collected data, the average number of sheets fed before a primary increment occurs can be calculated by dividing $F_S$ by $P_S$. Then, in the Controlling state 76, if the above calculated average number of sheets fed before a primary increment is exceeded, a secondary increment could be generated.

In another exemplary embodiment, however, a secondary increment may be generated when a specified number of sheets fed since the last primary increment has occurred. This specified number of sheets fed, referred to as F, can also be calculated in the Sampling state 74 by the following relation:

$$F = \frac{[(F_S P_M) + (P_S/2)]}{P_S}$$

where $F_S$ is the number of feeds during the sample period, $P_S$ is the plurality of primary increments in a sample period, and $P_M$ is a scaling factor. In this embodiment, $P_M$ can be used, if desired, as a scaling factor to cause the secondary increment to occur less often than would typically occur under a primary increment. So, for example, according to the previously described exemplary embodiment, where $P_M$ is set to two, the number of sheet feeds that occurred during the sample period is effectively two times what was previously measured during the sample period.

In another exemplary embodiment, a secondary increment can be equal, less, or larger in magnitude than a typical primary increment. This specified size of the secondary increment size, such as determined in the Sampling state 74, by the following relation:

$$S = \frac{[(S_S - S_E) + ((P_S P_D)/2)]}{P_S P_D}$$

where $S_S$ is the elevator counter at the sample start, $S_E$ is the elevator counter at the sample end, $P_S$ is the plurality of primary increments in a sample period, and $P_D$ is a scaling factor. In this embodiment, $P_D$ can be used, if desired, as a scaling factor to cause the size of the secondary increment to be equal, less, or greater in magnitude than would often occur under a primary increment. So, for example, according to the previously described exemplary embodiment, where $P_D$ is set to one-half, the magnitude of the secondary increment would be two times greater in magnitude than would normally occur under a primary increment.

The following is an exemplary description of the process of the above-described Discarding state 72 and Sampling state 74. At the start of a reproduction process, from a given sheet stack, the average number of sheets fed between incrementing the platform 14 is preferably determined. This can be accomplished by counting the number of sheets fed after the original primary increment until a specified later primary increment. Preferably, the original primary increment counted is discarded, because it tends to be abnormal, given that the paper level may be established prior to turning on the positive air source P, thus prior to the stack being fluffed. In an exemplary embodiment, the optimum value for the specified number of increments to use during the sampling period should be large enough to get a reasonably accurate average value, but small enough to enable the Controlling state 76 as soon as possible.

Likewise, when determining the average frequency of a primary increment, the average primary increment size can also be estimated. If a stepper motor is used, the average number of steps taken by the stepper motor can be accounted for on a per increment basis to determine the average primary increment size. If another motor or mechanism is used to drive the platform 14, such as a DC motor, a similar mechanism, such as an encoder, potentiometer, or motor command duration, it could be used to estimate and control the amount the platform 14 is raised. For example, the potentiometer cooperating with the gear set 16 (FIG. 1), can produce a signal to indicate the instantaneous height of the platform 14. It should be understood that estimating the average amount the platform 14 is raised during each primary increment would not necessarily be a requirement, but it could improve the accuracy of the disclosed process.

Once these averages are estimated, the lift motor $M_1$ can be commanded to raise the platform 14, whenever the control is desired. For example, if twice the average number of sheets have been fed since the last increment, the lift motor $M_1$ could be commanded to raise the platform 14 an amount equal to an average increment size. Obviously, the frequency and increment size can be optimized for any given reproduction system, such as by using the scaling factors $P_D$ and $P_M$.

In addition, counting the number of sheets fed between increments preferably compensates for sheet thickness, as long as the sheet thickness does not vary throughout the sheet stack. Thus, this scheme can work as long as the paper in the supply is the same thickness. However, other methods, as known in the art, can be used to compensate for varying sheet thickness.

Referring back to FIG. 5, in the Controlling state 76, a secondary increment can be initiated at any time, and is usually initiated in response to level control characteristics determined in the Sampling state 74. Furthermore, as described above, a secondary increment can occur many times in a row, which can be given by the parameter, $P_c$. Thus, in the Controlling state 76, the system can enable secondary increments that may change both in frequency and in magnitude.

Figure 7:
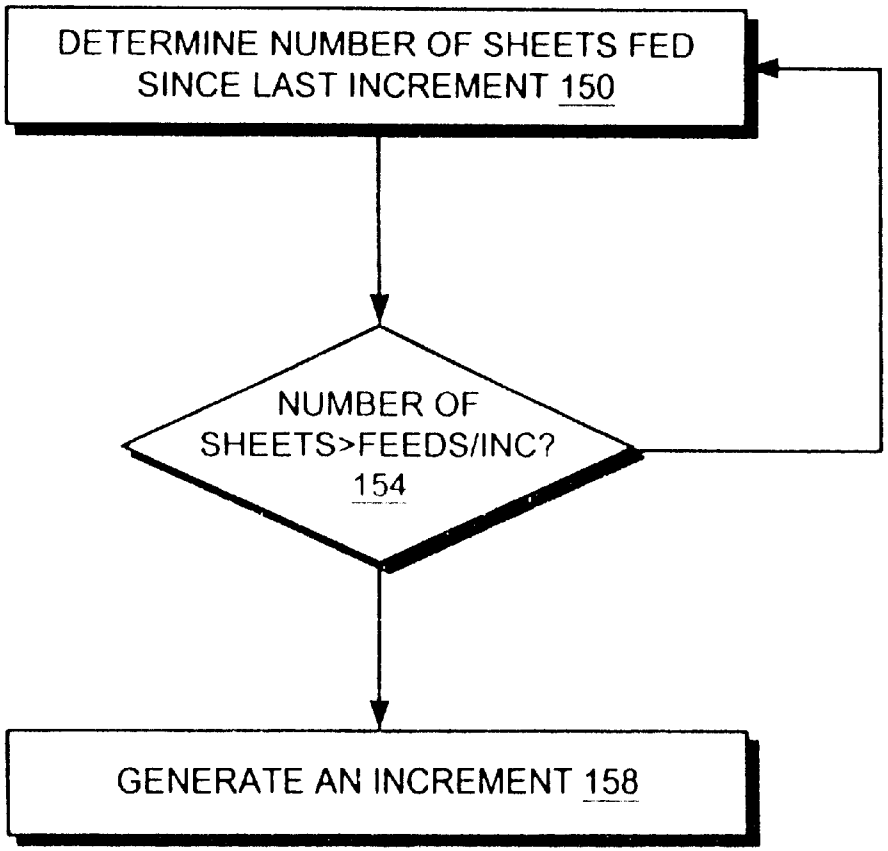
FIG. 7 is a flow diagram illustrating an exemplary method for generating an increment in accordance with the present embodiments.

FIG. 7 is a flow diagram illustrating an exemplary method for generating a secondary increment in accordance with the present embodiments. In step 150, the number of sheets fed since the last primary increment is counted. Per step 154, this number is compared to a known sheets fed before a primary increment occurs, such as described above. This could have been calculated or input during the Sampling state 74.

In the exemplary embodiment, however, the known sheets fed per increment is equal to the calculated F, where $$F = \frac{[(F_S P_M) + (P_S/2)]}{P_S}$$

and where $F_S$ is the number of feeds during the sample period, $P_S$ is the plurality of primary increments in a sample period, and $P_M$ is a scaling factor. In this embodiment, the number of sheets fed since the last primary increment is then compared to F.

In step 158, a secondary increment is generated if the number of sheets fed since the last primary increment is greater than or equal to the known sheets fed per increment. In the exemplary embodiment, the size of the increment is given by the relationship:

$$S = \frac{[(S_S - S_E) + ((P_S P_D)/2)]}{P_S P_D}$$

where $S_S$ is the elevator counter at the sample start, $S_E$ is the elevator counter at the sample end, $P_S$ is the plurality of primary increments in a sample period, and $P_D$ is a scaling factor.

If the receiver type is identified, one could chose to revert to earlier or input data for that receiver type rather than recalculating the average sheets between increment and increment size, if so desired. This would enable the benefits for a secondary increment immediately for any paper type that has previously been run.

It should be understood that the disclosed embodiments can be utilized in a variety of different ways without departing from the spirit and scope of the invention. For example, the secondary increments may be used to maintain the topmost sheet at the predetermined level, while the primary increments, such as switch 80 initiated increments, could be used as a backup to the secondary increments. Thus, according to this example, in the event the secondary increment neglects initiating an increment, the switches 80 might detect that an increment is necessary in order to maintain the topmost sheet at the predetermined level.

Furthermore, it should be understood that other types of receiver sheet supply and feeders can be used in accordance with the present embodiments. Thus, the parameters can be adjusted accordingly, by one skilled in the art using the teachings described herein, to accommodate the desired sheet supply and feeder. Additionally, the present embodiments can be tailored, by one skilled in the art, to accommodate the different device types that they are implemented on.

The present embodiments described herein, provide the ability to more effectively control a paper stack in a reproduction device, by initiating a secondary increment. The system and method have been implemented in a reproduction device utilizing a top feed vacuum feeder and switches 80 that generate a signal to indicate an increment. However, it should be understood that the present embodiments can be implemented in a reproduction device that utilizes other types of feeders and switches.

The disclosed embodiments provide a number of advantages and applications. Utilizing the disclosed embodiments, the present invention allows increased probability of feeding sheets when the receivers have a tendency to stick together during the pre-separation and fluffing phase. Additionally, the embodiments provide for better control of the top level of the unfluffed portion of the stack, which can improve the feed performance for some receivers. The exemplary embodiments utilize level control characterization and accordingly injects additional increments, as needed.

It should also be understood that the programs, processes, methods and systems described herein are not related or limited to any particular type of hardware, such as TTL logic or computer software, or both. Various types of general purpose or specialized processors, such as micro-controllers may be used with or perform operations in accordance with the teachings described herein.

In view of the wide variety of embodiments to which the principles of the present invention can be applied, it should be understood that the illustrated embodiments are exemplary only, and should not be taken as limiting the scope of the present invention. For example, more or fewer elements may be used in the block diagrams and signals may include analog, digital, or both. While various elements of the preferred embodiments have been described as being implemented in hardware, in other embodiments in software implementations may alternatively be used, and vice-versa.

The claims should not be read as limited to the described order or elements unless stated to that effect. Therefore, all embodiments that come within the scope and spirit of the following claims and equivalents thereto are claimed as the invention.

What is claimed is:

1. A method for facilitating receiver stack level control, comprising the steps of:

determining a number of sheets fed after a primary increment;

comparing the number of sheets fed to a known feeds per primary increment; and generating a secondary increment, if the number of sheets fed is greater than the known feeds per primary increment.

2. The method of claim 1, wherein the primary increment comprises initiation by a switch for the purpose of detecting a level of the topmost sheet.

3. The method of claim 1, wherein the secondary increment comprises initiation by a signal in response to the number of sheets fed being greater than the known feeds per primary increment.

4. The method of claim 1, wherein the secondary increment is equal, less, or greater in magnitude than the primary increment.

5. The method of claim 1, wherein the secondary increment is generated for a plurality times, forming a consecutive sequence of secondary increments.

6. The method of claim 1, wherein the known feeds per primary increment is input before the execution of the other method steps.

7. The method of claim 1, wherein the secondary increment is determined before the execution of the other method steps.

8. The method of claim 1, wherein the known feeds per primary increment is determined during a sampling state.

9. The method of claim 1, wherein the primary increment is determined during a sampling state.

10. The method of claim 1, wherein the known feeds per primary increment is determined by parameters including paper thicknesses.

11. The method of claim 1, further comprising:

determining a sample period of a plurality of primary increments;

determining the number of feeds during the sample period; and calculating the known feeds per primary increment.

12. The method of claim 11, wherein the secondary increment is generated in response to the relationship:

$$F = \frac{[(F_S P_M) + (P_S/2)]}{P_S}$$

where $F_S$ is the number of feeds during the sample period, $P_S$ is the plurality of primary increments in a sample period, and $P_M$ is a scaling factor.

13. The method of claim 11, wherein the magnitude of the secondary increment is generated in response to the relationship:

$$S = \frac{[(S_S - S_E) + ((P_S P_D)/2)]}{P_S P_D}$$

where $S_S$ is an elevator counter at a sample start, $S_E$ is the elevator counter at the sample end, $P_S$ is the plurality of primary increments in a sample period, and $P_D$ is a scaling factor.

14. The method of claim 11, wherein calculating the known feeds per primary increment is performed in a sampling state.

15. A method for facilitating receiver stack level control in a top feed vacuum corrugated feeder, comprising the steps of:

determining a number of sheets fed without a primary increment;

comparing the number of sheets fed to a known feeds per primary increment;

generating a secondary increment, if the number of sheets fed is greater than the known feeds per primary increment.

16. A method for facilitating redundant paper stack level control, comprising the steps of:

determining a sample period of a plurality of primary increments;

determining a number of feeds during the sample period;

calculating a feeds per primary increment, by dividing the number of feeds by the plurality of primary increments;

performing at least one secondary increment when a second number of feeds exceeds the feeds per primary increment.

17. A method for facilitating receiver stack level control, comprising the steps of:

generating a primary increment initiated by a switch indicative of the receiver stack level;

generating a secondary increment operative to compensate for incomplete adjustment of the receiver stack level by the primary increment.

18. The method of claim 17, wherein the secondary increment is generated by a software means.

19. The method of claim 17, wherein the primary increment includes generating an additional increment when it is necessary to ensure the receiver stack level maintains a proper level.

20. A method for facilitating receiver stack level control, comprising the steps of:

generating a primary increment initiated by a switch indicative of the receiver stack level;

generating a secondary increment not initiated by the switch and operative to compensate for incomplete adjustment of the receiver stack level by the primary increment.

* * * * *